US006345636B1

(12) United States Patent
Christian

(10) Patent No.: US 6,345,636 B1
(45) Date of Patent: Feb. 12, 2002

(54) ROLLER COVER WASHER

(76) Inventor: Brian Christian, 45 Fairview Ave., North Plainfield, NJ (US) 07060

( * ) Notice: Subject to any disclaimer, the term of this patent is extended or adjusted under 35 U.S.C. 154(b) by 0 days.

(21) Appl. No.: 09/453,618

(22) Filed: Dec. 2, 1999

(51) Int. Cl.[7] ..... B08B 3/02
(52) U.S. Cl. ..... 134/140; 134/149; 134/900
(58) Field of Search ..... 134/900, 138, 134/140, 149

(56) References Cited

U.S. PATENT DOCUMENTS 2,773,274 A 12/1956 Beech
3,886,960 A 6/1975 Krueger
4,294,272 A 10/1981 Klaiber
4,311,158 A 1/1982 Harvey
D267,123 S 11/1982 Fuller
4,448,209 A 5/1984 Lindsay

*Primary Examiner*—Philip R. Coe

(57) ABSTRACT

A roller cover washer for removing paint from a paint roller cover. The roller cover washer includes a roller housing having a front portion and a rear portion. The front portion has a front wall, a rear wall and a bottom wall for defining an interior space therebetween. The interior space is for receiving a paint roller cover. At least one of a fluid inlet apertures are in fluid communication with the interior space. A plurality of fluid outlet apertures through the front wall. The rear portion is coupled to the rear wall. A fluid connector is in fluid communication with the fluid inlet apertures. A motor housing is releasably coupled along a top edge of the roller housing. The motor housing has a motor. A switch is operationally coupled to the motor for controlling the motor. A cover retainer is for securing the roller cover within the inner space of the roller housing. The cover retainer is operationally coupled to the motor. A bracket is coupled to the rear wall of the roller housing.

14 Claims, 5 Drawing Sheets

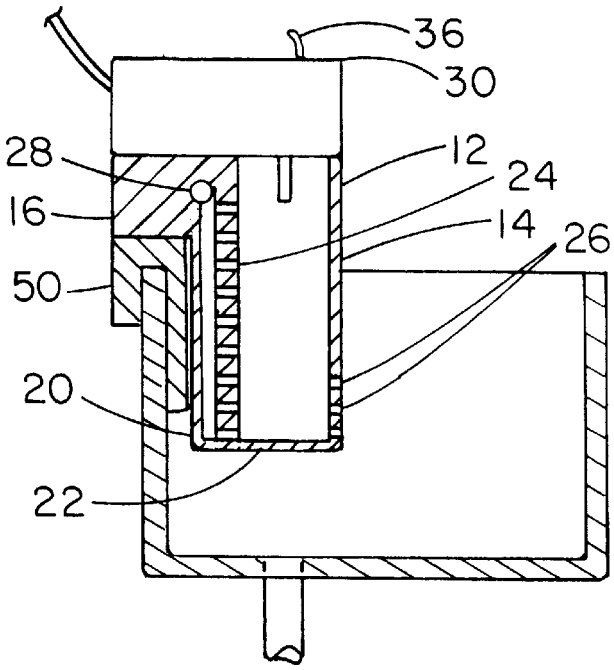
FIG. 1
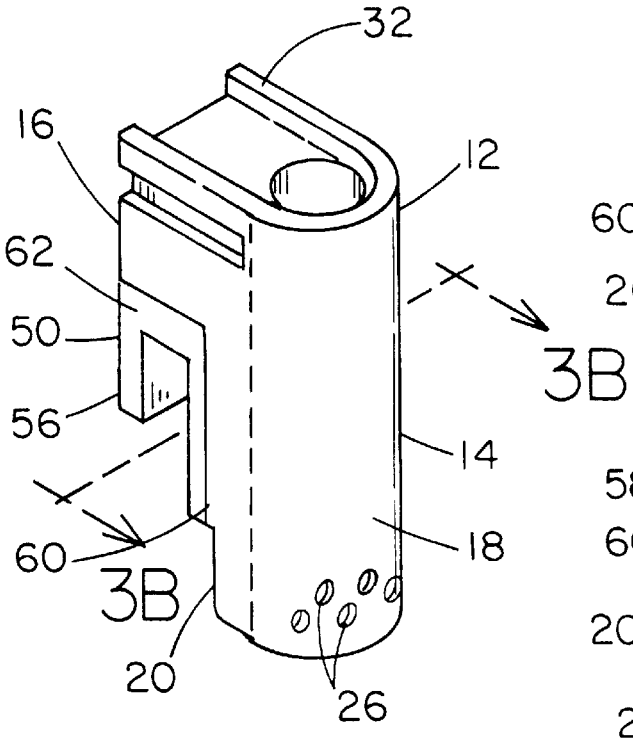
FIG. 2
FIG. 3A
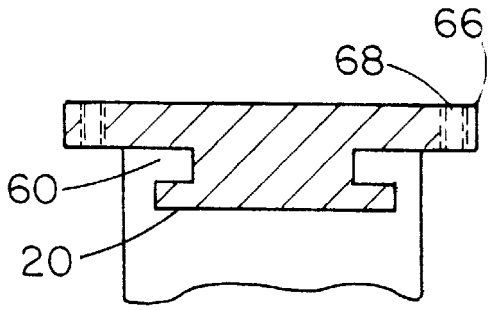
FIG. 3B
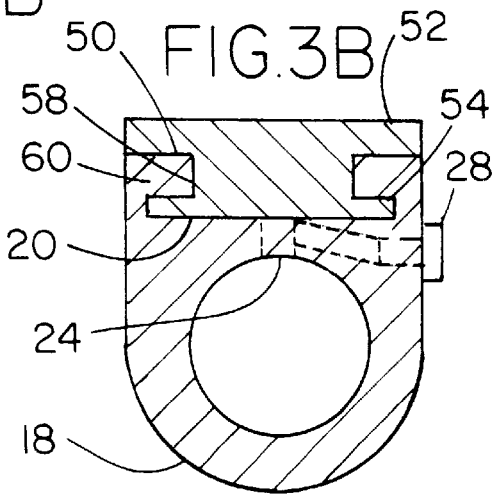

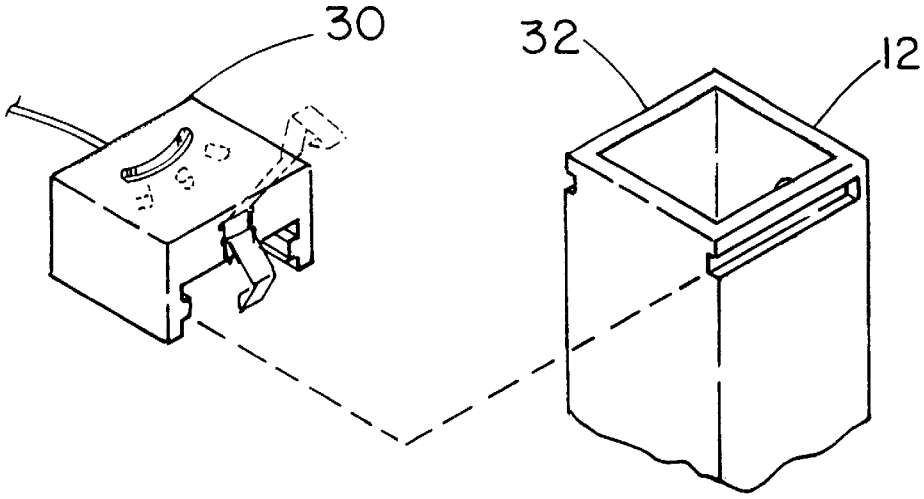
FIG. 6
FIG. 8
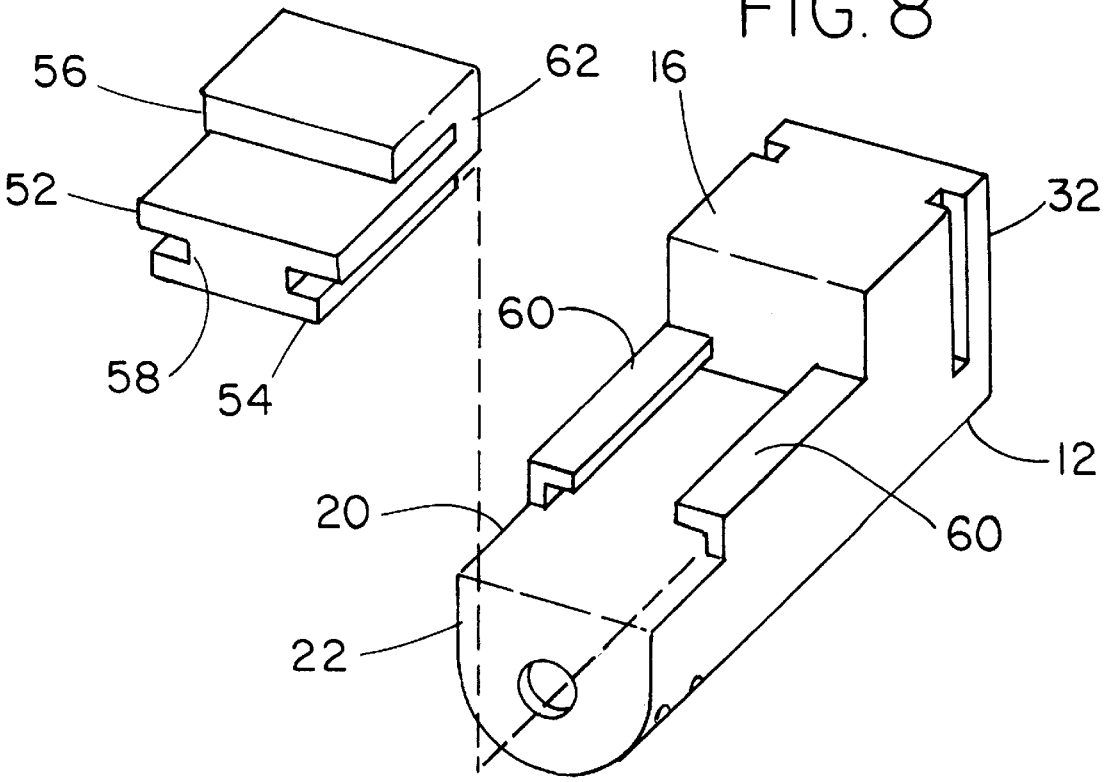

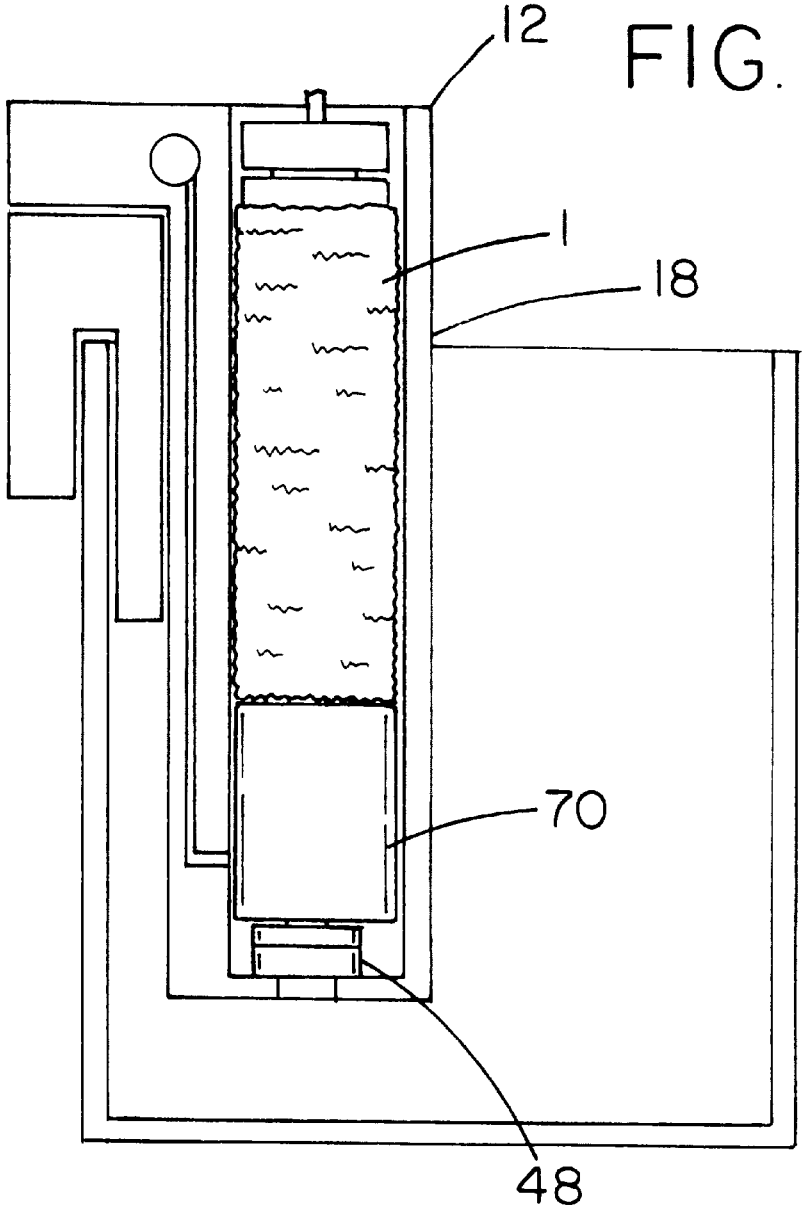
FIG. 10
FIG. 9
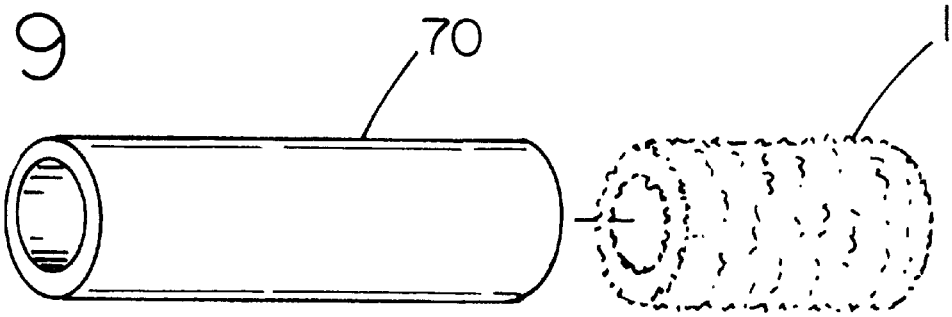

ROLLER COVER WASHER

BACKGROUND OF THE INVENTION

1. Field of the Invention

The present invention relates to cleaners for paint rollers and more particularly pertains to a new roller cover washer for removing paint from a paint roller cover.

2. Description of the Prior Art

The use of cleaners for paint rollers is known in the prior art. More specifically, cleaners for paint rollers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,886,960; U.S. Pat. No. 4,448,209; U.S. Pat. No. 4,311,158; U.S. Pat. No. 4,294,272; U.S. Pat. No. Des. 267,123; and U.S. Pat. No. 2,773,274.

While these devices fulfill their respective, particular objectives and requirements, the aforementioned patents do not disclose a new roller cover washer. The inventive device includes a roller housing having a front portion and a rear portion. The front portion has a front wall, a rear wall and a bottom wall for defining an interior space therebetween. The interior space is for receiving a paint roller cover. At least one of a fluid inlet apertures are in fluid communication with the interior space. A plurality of fluid outlet apertures through the front wall. The rear portion is coupled to the rear wall. A fluid connector is in fluid communication with the fluid inlet apertures. A motor housing is releasably coupled along a top edge of the roller housing. The motor housing has a motor. A switch is operationally coupled to the motor for controlling the motor. A cover retainer is for securing the roller cover within the inner space of the roller housing. The cover retainer is operationally coupled to the motor. A bracket is coupled to the rear wall of the roller housing.

In these respects, the roller cover washer according to the present invention substantially departs from the conventional concepts and designs of the prior art, and in so doing provides an apparatus primarily developed for the purpose of removing paint from a paint roller cover.

SUMMARY OF THE INVENTION

In view of the foregoing disadvantages inherent in the known types of cleaners for paint rollers now present in the prior art, the present invention provides a new roller cover washer construction wherein the same can be utilized for removing paint from a paint roller cover.

The general purpose of the present invention, which will be described subsequently in greater detail, is to provide a new roller cover washer apparatus and method which has many of the advantages of the cleaners for paint rollers mentioned heretofore and many novel features that result in a new roller cover washer which is not anticipated, rendered obvious, suggested, or even implied by any of the prior art cleaners for paint rollers, either alone or in any combination thereof.

To attain this, the present invention generally comprises a roller housing having a front portion and a rear portion. The front portion has a front wall, a rear wall and a bottom wall for defining an interior space therebetween. The interior space is for receiving a paint roller cover. At least one of a fluid inlet apertures are in fluid communication with the interior space. A plurality of fluid outlet apertures through the front wall. The rear portion is coupled to the rear wall. A fluid connector is in fluid communication with the fluid inlet apertures. A motor housing is releasably coupled along a top edge of the roller housing. The motor housing has a motor. A switch is operationally coupled to the motor for controlling the motor. A cover retainer is for securing the roller cover within the inner space of the roller housing. The cover retainer is operationally coupled to the motor. A bracket is coupled to the rear wall of the roller housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new roller cover washer apparatus and method which has many of the advantages of the cleaners for paint rollers mentioned heretofore and many novel features that result in a new roller cover washer which is not anticipated, rendered obvious, suggested, or even implied by any of the prior art cleaners for paint rollers, either alone or in any combination thereof.

It is another object of the present invention to provide a new roller cover washer which may be easily and efficiently manufactured and marketed.

It is a further object of the present invention to provide a new roller cover washer which is of a durable and reliable construction.

An even further object of the present invention is to provide a new roller cover washer which is susceptible of a low cost of manufacture with regard to both materials and labor, and which accordingly is then susceptible of low prices of sale to the consuming public, thereby making such roller cover washer economically available to the buying public.

Still yet another object of the present invention is to provide a new roller cover washer which provides in the apparatuses and methods of the prior art some of the advantages thereof, while simultaneously overcoming some of the disadvantages normally associated therewith.

Still another object of the present invention is to provide a new roller cover washer for removing paint from a paint roller cover.

Yet another object of the present invention is to provide a new roller cover washer which includes a roller housing having a front portion and a rear portion. The front portion has a front wall, a rear wall and a bottom wall for defining an interior space therebetween. The interior space is for receiving a paint roller cover. At least one of a fluid inlet apertures are in fluid communication with the interior space. A plurality of fluid outlet apertures through the front wall. The rear portion is coupled to the rear wall. A fluid connector is in fluid communication with the fluid inlet apertures. A motor housing is releasably coupled along a top edge of the roller housing. The motor housing has a motor. A switch is operationally coupled to the motor for controlling the motor. A cover retainer is for securing the roller cover within the inner space of the roller housing. The cover retainer is operationally coupled to the motor. A bracket is coupled to the rear wall of the roller housing.

Still yet another object of the present invention is to provide a new roller cover washer that provides a fast and efficient means of cleaning a paint roller cover.

Even still another object of the present invention is to provide a new roller cover washer that reduces the amount mess associated with cleaning a paint roller cover in a conventional means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a cross-sectional view of a new roller cover washer according to the present invention.

FIG. 2 is a perspective view roller housing and bracket of the present invention.

FIG. 3A is a cross-sectional view of the roller housing and wall mountable bracket of the present invention.

FIG. 3B is a cross-sectional view of the roller housing and sink mountable bracket along line 3B—3B of FIG. 2 of the present invention.

FIG. 6 is an enlarged cross-sectional view of the present invention of FIG. 1.

FIG. 8 is an exploded perspective view of the bracket and the roller housing of the present invention shown in its environment.

FIG. 9 is a cross-sectional view showing a roller cover and spacer of the present invention of FIG. 1.

FIG. 10 is a perspective view of the spacer of the present invention of FIG. 1.

DESCRIPTION OF THE PREFERRED EMBODIMENT

Figure 4:
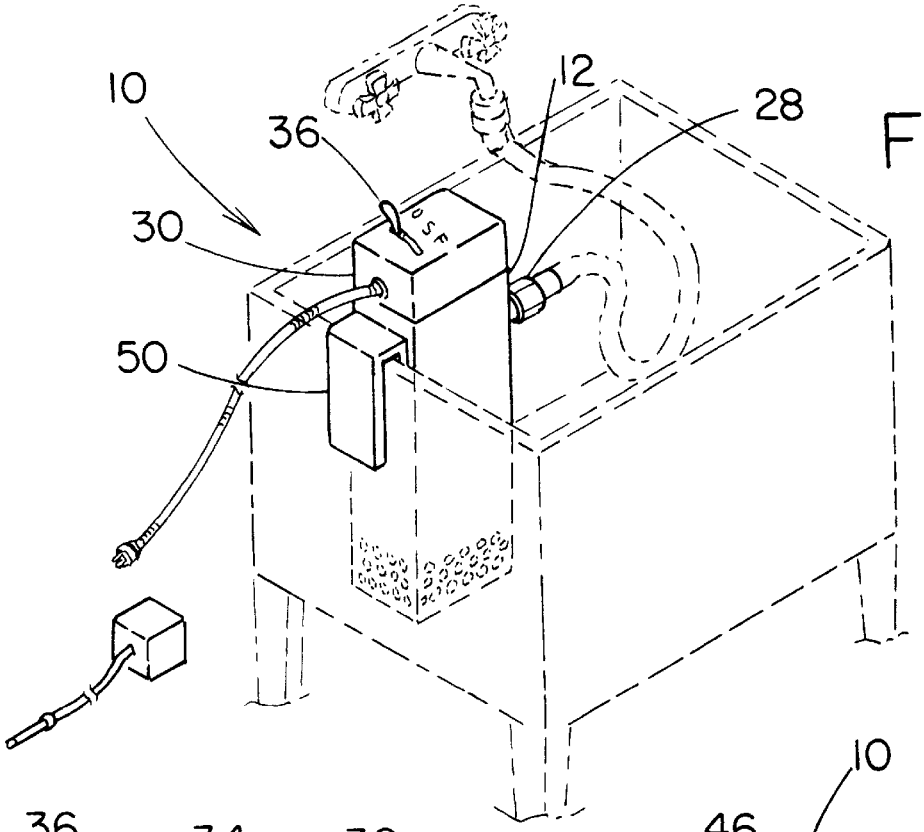
FIG. 4 is a perspective view of the present invention shown in its environment.

With reference now to the drawings, and in particular to FIGS. 1 through 8 thereof, a new roller cover washer embodying the principles and concepts of the present invention and generally designated by the reference numeral 10 will be described.

As best illustrated in FIGS. 1 through 8, the roller cover washer 10 generally comprises a roller housing 12 having a front portion 14 and a rear portion 16. The front portion has an arcuate front wall 18, a rear wall 20 and a bottom wall 22 for defining a cylindrical interior space therebetween. The interior space is for receiving a paint roller cover. A plurality of fluid inlet apertures 24 are linearly aligned through the rear wall. A plurality of fluid outlet apertures 26 extend through the front wall. The outlet apertures are positioned proximate a bottom end of the front wall. The rear portion has a generally rectangular configuration. The rear portion is coupled to an upper portion of the rear wall. A fluid connector 28 is positioned through a side wall of the rear portion such that the fluid connector is in fluid communication with the fluid inlet apertures.

Figure 5:
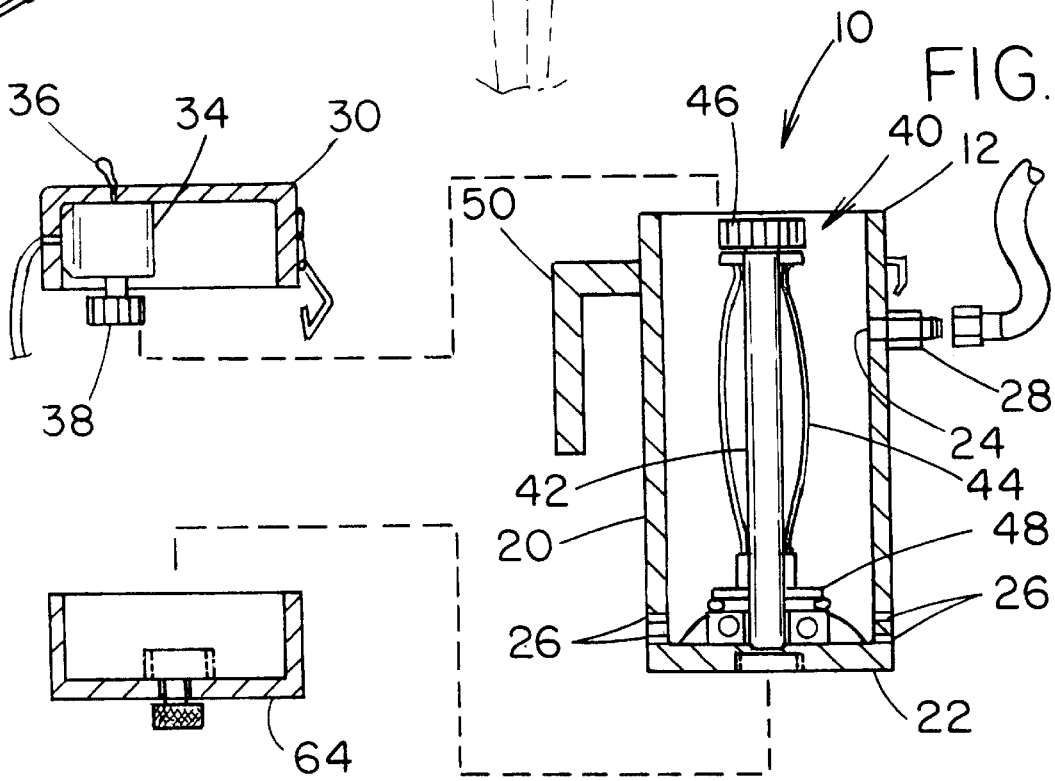
FIG. 5 is an exploded cross-sectional view of the present invention.

As shown in FIGS. 5 and 6, a motor housing 30 is releasably coupled along a top edge 32 of the roller housing. The motor housing has an electric motor 34. A switch 36 is operationally coupled to the motor for controlling the motor. A rotational transfer means 38 is operationally coupled to the motor. The switch having an off and a low and high setting for controlling speed of rotation that the motor turns the rotational transfer means.

Figure 7:
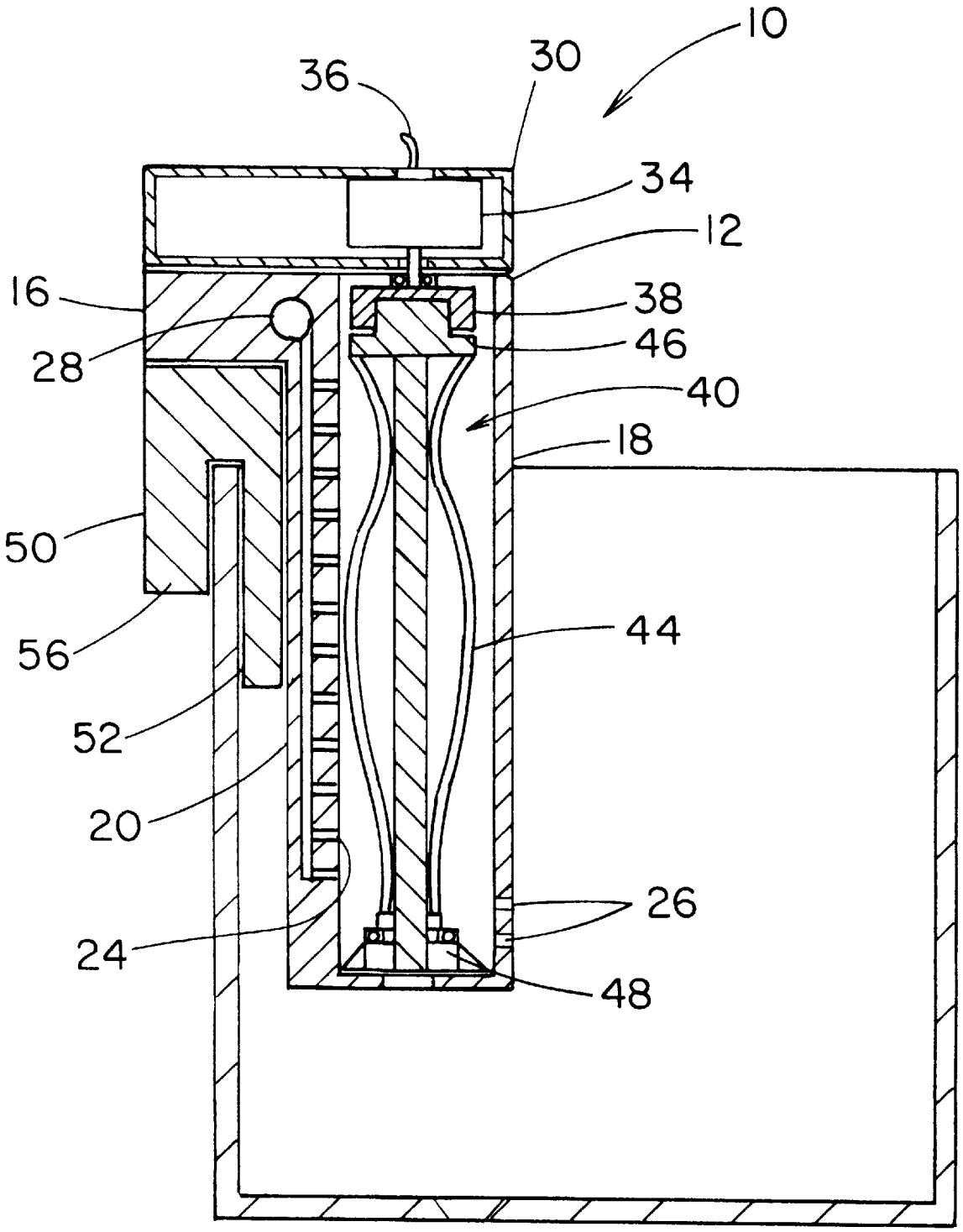
FIG. 7 is an exploded perspective view of the motor housing and the roller housing of the present invention shown in its environment.

A cover retainer 40 is for securing the roller cover within the inner space of the roller housing, as shown in FIGS. 5 and 7. The cover retainer has a shaft portion 42 and a plurality of S-shaped retaining arms 44. The shaft portion has an upper end portion 46 and a lower secured end 48. The lower secured end is for rotatably engaging the bottom wall of the roller housing. The upper end portion is for releasably engaging the rotational transfer means of the motor housing such that the motor rotates the rotational transfer means and the rotation transfer means transfers rotation to the upper end portion. Each of the S-shaped retaining arms is rigidly coupled to the shaft portion proximate the lower secured end and rigidly coupled to the upper end portion. The S-shaped retaining arms are for releasably engaging the roller cover.

A bracket 50 has an exterior flange 52, an interior flange 54 and a bracing wall 56. The interior flange is coupled to a spacing portion 58. The exterior flange is coupled to the spacing portion opposite the interior flange such that the interior flange is in parallel relationship to the exterior flange. The interior flange is for inserting in a pair of L-shaped holders 60 coupled to the rear wall of the roller housing. An upper extent 62 orthogonally extends outward from an upper edge of the exterior flange. The bracing wall is coupled to the upper extent such that the bracing wall is in parallel relationship to the exterior wall. The bracket is for releasably engaging one of the walls of the sink.

In an embodiment an end cap 64 may be provided that can be secured to the bottom wall of the front portion of the roller housing so that the walls of the end cap extend over the fluid outlet apertures and prevent the fluid from being released from the inner space until draining is desired. Also a spacer 70 may be used in combination with roller covers that are shorter than a length of the cover retainer such that the roller cover and the spacer extend the full length of the cover retainer. The spacer can be a length from 3 inches to 9 inches.

In an embodiment, the bracket has a flanged portion 66 that has a width greater than the width of the rear wall of the roller housing. The bracket has a plurality of holes 68 for having screws put through so that the bracket may be secured to a wall proximate the sink.

In use, a user would place the roller housing with its bracket on the wall of a utility sink and connect the faucet to the fluid connection via a hose. The user would then place a roller cover in need of cleaning into the interior space and over the cover retainer. The motor housing would be place over the top of the roller housing such that the rotation transfer means engaged the upper end portion of the retaining means. The housing would then be secured to the roller housing to ensure that no water would leak out of the top of the unit. The user would then turn the water and the motor on. The water would flow into the interior space and the motor would rotate the retaining means thus turning the roller cover within the incoming water. The water and paint mixture would then be drained through the fluid outlet apertures at the bottom of the unit. The end cap could be used to cover the fluid outlet holes thus preventing the release of the water and paint mixture until desired by the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paint roller cover cleaning apparatus for cleaning paint from a paint roller cover in a sink having a plurality of walls, the cover cleaning apparatus comprising:

a roller housing having a front portion and a rear portion, said front portion having a front wall, a rear wall and a bottom wall for defining an interior space therebetween, said interior space being for receiving the paint roller cover, at least one fluid inlet aperture being in fluid communication with said interior space, a plurality of fluid outlet apertures through said front wall, said rear portion being coupled to said rear wall, a fluid connector being in fluid communication with said fluid inlet aperture;

a motor housing being releasably coupled along a top edge of said roller housing, said motor housing having a motor, a switch being operationally coupled to said motor for controlling said motor;

a cover retainer being for securing the roller cover within said interior space of said roller housing, said cover retainer being operationally coupled to said motor;

a bracket being coupled to said rear wall of said roller housing.

2. The cover cleaning apparatus as set forth in claim 1 wherein said fluid inlet aperture extends through said rear wall of said roller housing.

3. The cover cleaning apparatus as set forth in claim 2 wherein said fluid connector extends through a side wall of said rear portion such that said fluid connector is in fluid communication with said fluid inlet aperture.

4. The cover cleaning apparatus as set forth in claim 1 wherein said motor housing has a seal, said seal being adapted for sealing the fluid into said interior space and preventing the fluid from contacting said motor.

5. The cover cleaning apparatus as set forth in claim 1 wherein said cover retainer has a lower secured end, said lower secured end is for rotatably engaging said bottom wall of said roller housing.

6. The cover cleaning apparatus as set forth in claim 5 wherein said cover retainer further comprises a shaft coupled to said lower secured end and an upper end portion coupled to said shaft opposite said lower secured end, said upper end portion is operationally coupled to said motor.

7. The cover cleaning apparatus as set forth in claim 6 wherein said cover retainer further comprises a plurality of S-shaped retaining arms, said retaining arms are coupled between said upper end portion and said lower secured end.

8. The cover cleaning apparatus as set forth in claim 1 wherein said bracket is for releasably engaging a pair of L-shaped holders coupled to said rear wall of said roller housing.

9. The cover cleaning apparatus as set forth in claim 8 wherein said bracket has an inner portion, an outer portion and a top member, said inner portion is for releasably engaging said L-shaped holders, said top member extends outward from said inner portion, said outer portion extends downward from said top member opposite said inner portion to form an inverted U-shaped configuration, said bracket being for releasably engaging the walls of the sink.

10. The cover cleaning apparatus as set forth in claim 8 wherein said bracket has a connecting portion and a flanged portion, said connecting portion is for releasably engaging said L-shaped holders, said flanged portion has a plurality of holes therethrough and is coupled to said connecting portion, said flanged portion wider than said rear wall such that said bracket is securable proximate the sink.

11. The cover cleaning apparatus as set forth in claim 1 further comprises an end cap having a base portion and a periphery wall, said periphery wall extending upward from said base portion and being for engaging a bottom end of said front portion, said periphery wall being for abutting against said front portion and covering said fluid outlet apertures.

12. The cover cleaning apparatus as set forth in claim 11 wherein a securing means extends through said base portion of said end cap, said securing means is for releasably engaging said bottom wall of said roller housing.

13. The cover cleaning apparatus as set forth in claim 1 further comprises a spacer being for fitting over said cover retainer and abutting against an end of the paint roller cover such that a length from a free end of said spacer to a free end of the paint roller cover is substantially equal to a length of the cover retainer, said spacer having a bore for inserting said cover retainer through said spacer.

14. A paint roller cover cleaning apparatus for cleaning pain a paint roller cover in a sink having a plurality of walls, the cover cleaning apparatus comprising:

a roller housing having a front portion and a rear portion, said front portion having an arcuate front wall, a rear wall and a bottom wall for defining a cylindrical interior space therebetween, said interior space being for receiving the paint roller cover, a plurality of fluid inlet apertures being linearly aligned through said rear wall, a plurality of fluid outlet apertures through said front wall, said outlet apertures being positioned proximate a bottom end of said front wall, said rear portion having a generally rectangular configuration, said rear portion being coupled to an upper portion of said rear wall, a fluid connector being positioned through a side wall of said rear portion such that said fluid connector is in fluid communication with said fluid inlet apertures;

a motor housing being releasably coupled along a top edge of said roller housing, said motor housing having an electric motor, a switch being operationally coupled to said motor for controlling said motor, a rotational transfer means being operationally coupled to said motor;

a cover retainer being for securing the roller cover within said inner space of said roller housing, said cover retainer having a shaft portion and a plurality of S-shaped retaining arms, said shaft portion having an upper end portion and a lower secured end, said lower secured end being for rotatably engaging said bottom wall of said roller housing, said upper end portion being for releasably engaging said rotational transfer means of said motor housing such that said motor rotates said rotational transfer means and said rotation transfer means transfers rotation to said upper end portion, each of said S-shaped retaining arms being rigidly coupled to said shaft portion proximate said lower secured end and rigidly coupled to said upper end portion, said S-shaped retaining arms being for releasably engaging the roller cover;

a bracket having an exterior flange, an interior flange and a bracing wall, said interior flange being coupled to a spacing portion, said exterior flange being coupled to said spacing portion opposite said interior flange such that said interior flange being in parallel relationship to said exterior flange, said interior flange being for inserting in a pair of L-shaped holders coupled to said rear wall of said roller housing, an upper extent being orthogonally extending outward from an upper edge of said exterior flange, said bracing wall being coupled to said upper extent such that said bracing wall is in parallel relationship to said exterior wall, said bracket being for releasably engaging one of the walls of the sink.

* * * * *